US005405244A

United States Patent [19]

Boyd

[11] Patent Number: 5,405,244

[45] Date of Patent: Apr. 11, 1995

[54] CERAMIC BLADE ATTACHMENT SYSTEM

[75] Inventor: Gary L. Boyd, Alpine, Calif.

[73] Assignee: Solar Turbines Incorporated, San Diego, Calif.

[21] Appl. No.: 169,436

[22] Filed: Dec. 17, 1993

[51] Int. Cl.[6] ..... F01D 5/02; F01D 5/30

[52] U.S. Cl. ..... 416/214 A; 416/215; 416/218; 416/244 A

[58] Field of Search ..... 416/214 A, 215, 218, 416/234, 244 A

[56] References Cited

U.S. PATENT DOCUMENTS

| | | | |
|---|---|---|---|
| 1,061,754 | 5/1913 | Knape | 416/244 A |
| 1,314,806 | 2/1919 | Hirt | 416/215 |
| 1,345,678 | 7/1920 | Kasley | 416/218 |
| 1,362,074 | 12/1920 | Baumann | 416/214 A |
| 2,772,852 | 12/1956 | Stalker | 416/244 A |
| 4,102,603 | 7/1978 | Smith et al. | 416/244 A |
| 4,397,609 | 8/1983 | Kochendorfer | 416/214 A |

*Primary Examiner*—Edward K. Look
*Assistant Examiner*—Michael S. Lee
*Attorney, Agent, or Firm*—Trevor B. Joike; Marshall, O'Toole, Gerstein, Murray & Borun

[57] ABSTRACT

A retainer ring is arranged to mount turbine blades to a turbine disk so that aerodynamic forces produced by a gas turbine engine are transferred from the turbine blades to the turbine disk to cause the turbine blades and turbine disk to rotate, but so that centrifugal forces of the turbine blades resulting from the rotation of the turbine blades and turbine disk are not transferred from the turbine blades to the turbine disk.

35 Claims, 4 Drawing Sheets

CERAMIC BLADE ATTACHMENT SYSTEM

"The government of the United States of America has rights in this invention pursuant to Contract No DE-AC02-92CE40960 awarded by the United States of Department of Energy."

TECHNICAL FIELD

The present invention relates generally to a gas turbine engine, and more particularly to a turbine wheel assembly for a gas turbine engine wherein the turbine wheel assembly includes a turbine blade attached to a turbine disk.

BACKGROUND ART

In the operation of a gas turbine engine, air at atmospheric pressure is initially compressed by a compressor, and the resulting compressed air is delivered to a combustion stage. In the combustion stage, heat is added to the compressed air leaving the compressor by mixing fuel with the compressed air and by burning the fuel/air mixture. The gas flow resulting from the combustion of the fuel/air mixture in the combustion stage expands through a turbine, and some of the energy of the gas flow is used to drive a turbine in order to produce mechanical power.

One form of turbine is an axial turbine having one or more stages, wherein each stage employs one row of stationary nozzle guide vanes and one row of moving blades. The row of moving blades is mounted on a turbine disk. The nozzle guide vanes are aerodynamically designed to direct incoming gas from the combustion stage onto the turbine blades to thereby aerodynamically transfer kinetic energy to the blades.

In the past, the combustion gases entering the turbine typically have had a gas entry temperature in the range of 850° to at least 1200° F. Since the efficiency and work output of the turbine engine are related to the gas entry temperature of the incoming combustion gases, there is a trend in gas turbine engine technology to increase the gas entry temperature. A consequence of increasing the gas entry temperature of the combustion gases in a gas turbine engine is that the materials of the nozzle guide vanes and blades must be chosen so that the nozzle guide vanes and blades can resist such increased gas entry temperatures.

Historically, nozzle guide vanes and blades have been made of metals such as high temperature steels and, more recently, nickel alloys. Even with these types of high temperature materials, it has been found necessary to provide internal cooling passages in order to prevent melting of these materials. Also, ceramic coatings can be applied to the nozzle guide vanes and blades to enhance the heat resistance of such nozzle guide vanes and blades. In specialized applications, nozzle guide vanes and blades are being made entirely of ceramic, which resists even higher gas entry temperatures.

However, if the nozzle guide vanes and/or blades are made of ceramic, which has a different chemical composition, physical property, and coefficient of thermal expansion to that of a metal supporting structure such as the disk to which the blades are typically mounted, then undesirable stresses, a portion of which are thermal stresses, will result between the nozzle guide vanes and/or blades and their supports when the turbine engine is operating. Such undesirable thermal stresses cannot effectively be contained by cooling.

Furthermore, conventional joints between blades and disks of a turbine have typically used a fir tree, or a dove tail, root design. Historically, a dove tail root design has been used with a ceramic blade to attach the blade to a metallic disk. A metallic compliant layer of material is used between the highly stressed ceramic blade root and the metallic disk to accommodate the relative movement, and resulting sliding friction, that may occur. The sliding friction between the ceramic blade and the metallic disk creates a contact tensile stress on the ceramic that degrades the surface of the ceramic. This degradation in the surface of the ceramic occurs in a tensile stress zone of the blade root. Therefore, when a surface flaw is generated in the ceramic of critical size, the blade root fails catastrophically.

Other turbine wheel assemblies involve bonding a ceramic ring, having a plurality of ceramic blades integrally formed thereon, to a fully dense ceramic disk, or involve the use of a ceramic disk having ceramic blades integrally formed therewith. All such prior art arrangements have been developed based on the assumption that the disk material must react to both the centrifugal and aerodynamic loads which are imposed by and on the blades under normal operating conditions of the gas turbine engine. That is, since the blades and disk of these prior art turbine wheels are, for the most part, rigid structures, the aerodynamic loads imparted onto the blades by the expansion of the hot gases produced by the combustion stage, and the centrifugal forces produced by the blades from the resulting disk rotation, are transferred from the blades to the disk. While disk materials have primarily been either of metallic composition for engines with turbine inlet temperatures less than approximately 2200° F., and have been monolithic or composite ceramic materials for turbine inlet temperatures greater than 2200° F., the prior art turbine wheels which are designed on the assumption that the disk must react to both the centrifugal and aerodynamic forces of the blades have been massive structures.

The present invention overcomes one or more of the problems as set forth above.

DISCLOSURE OF THE INVENTION

In accordance with one aspect of the present invention, a turbine wheel assembly includes a disk, a blade, and a mounting means for mounting the blade to the disk so that, as the disk rotates, centrifugal forces of the blade are substantially isolated from the disk.

In accordance with another aspect of the present invention, a turbine wheel assembly includes a blade, a position establishing means for establishing a spatial position for the blade, and mounting means for mounting the blade to the position establishing means so that, as the position establishing means and the blade rotate, centrifugal forces of the blade are substantially isolated from the position establishing means.

In accordance with yet another aspect of the present invention, a turbine assembly comprises a hub, a disk mounted to the hub, a plurality of blades arranged to receive rotation inducing forces, and a retainer ring arranged to mount the plurality of blades to the disk at an outer perimeter of the disk so that the rotation inducing forces applied to the plurality of blades cause the plurality of blades, the disk, and the hub to rotate and so that, as the plurality of blades, the disk, and the hub rotate, centrifugal forces of the plurality of blades are substantially isolated from the disk.

BRIEF DESCRIPTION OF THE DRAWINGS

These and other features and advantages will become more apparent from the following detailed description of the invention when taken in conjunction with drawings in which.

BEST MODE FOR CARRYING OUT THE INVENTION

Figure 1:
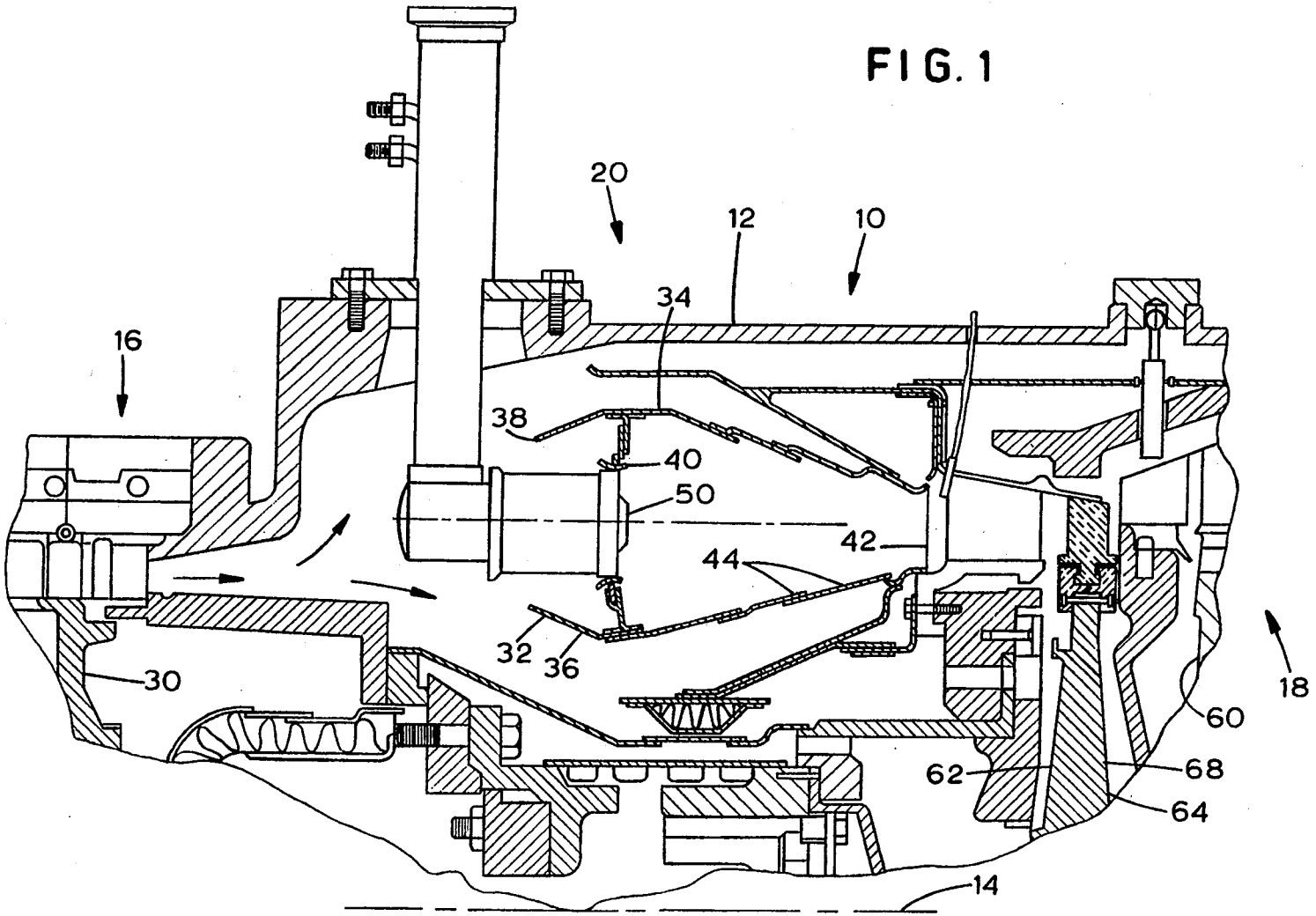
FIG. 1 is a partial sectional side view of a gas turbine engine embodying the present invention.

As shown in FIG. 1, a gas turbine engine 10 has an outer housing 12 and a central axis 14. Positioned within the outer housing 12 and centered about the central axis 14 is a compressor section 16, a turbine section 18, and a combustor section 20 positioned operatively between the compressor section 16 and the turbine section 18.

When the gas turbine engine 10 is in operation, the compressor section 16 causes a flow of compressed air. At least part of this compressed air is communicated to the combustor section 20. The compressor section 16 may include an axial stage compressor 30 but may, as an alternative, include a radial compressor or any other source for producing compressed air. The combustor section 20 includes an annular combustor 32. The annular combustor 32 has a generally cylindrical outer shell 34 and a generally cylindrical inner shell 36 which are positioned coaxially about the central axis 14. An inlet end of the annular combustor 32 has a plurality of generally evenly spaced openings 40 therein. The annular combustor 32 also has an outlet end 42.

In the arrangement of the gas turbine engine 10 shown in FIG. 1, the annular combustor 32 is constructed of a plurality of generally conical segments 44. Each of the evenly spaced openings 40 has an injector 50 positioned therein. As an alternative to the annular combustor 32, the combustor section 20 may include a plurality of can type combustors.

The turbine section 18 includes a power turbine 60 having an output shaft, not shown, connected thereto for driving an accessory component such as a generator. Another portion of the turbine section 18 includes a gas producer turbine 62 connected in driving relationship to the compressor section 16.

Figure 2:
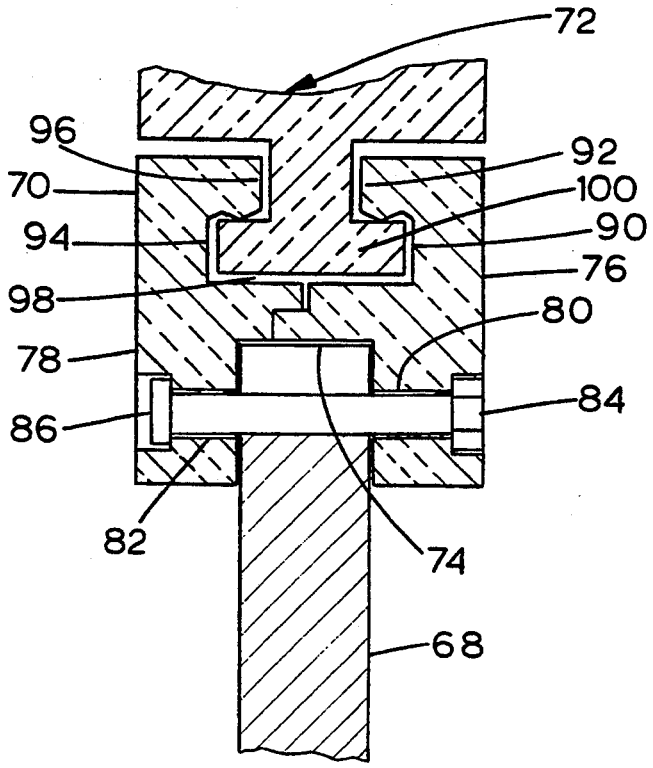
FIG. 2 is an enlarged sectional view of a portion of FIG. 1 and illustrates one embodiment of a blade retaining arrangement according to the present invention.
Figure 3:
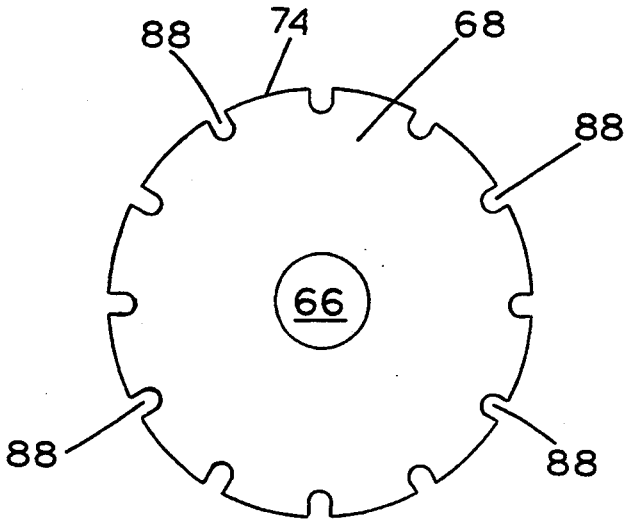
FIG. 3 is a side view of the disk of the turbine wheel according to the present invention.
Figure 4:
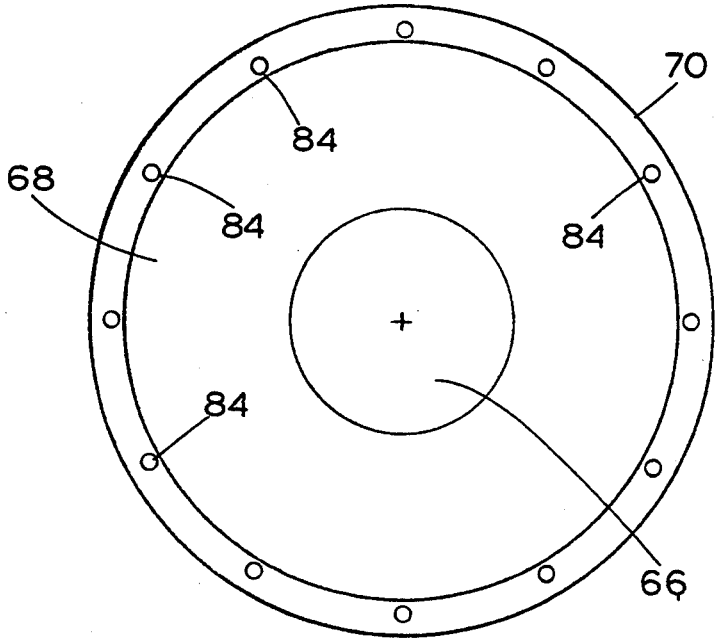
FIG. 4 is a side view of the disk and retainer ring according to the present invention.

As shown in FIGS. 1, 2, 3, and 4, the gas producer turbine 62 includes a turbine wheel assembly 64 rotationally positioned about a hub 66 which is centered about the central axis 14. The turbine wheel assembly 64 includes a disk 68 suitably attached to the hub 66. The turbine wheel assembly 64 also includes a retainer ring 70 which attaches a plurality of blades, one blade 72 of which is shown in FIG. 2, around an outer perimeter 74 of the disk 68. As shown in FIG. 4, the retainer ring 70 is substantially commensurate with the outer perimeter 74 of the disk 68. The retainer ring 70 and the blade 72, for example, may be ceramic, and the disk 68, for example, may be ceramic, high temperature metal, or a high temperature composite.

As shown in FIG. 2, the retainer ring 70 has a first ring 76 and a second ring 78. A hole 80 in the first ring 76, and a hole 82 in the second ring 78, are arranged to receive a member in the form of a fastener 84. For example, the fastener 84 may be in the form of a bolt which is arranged to receive a nut 86. Alternatively, the fastener 84 may be a pin which is arranged to receive a clip. Accordingly, the fastener 84 fastens the first and second rings 76 and 78 together.

Around the outer perimeter 74 of the disk 68 are a plurality of slots 88 each of which receives a corresponding fastener 84. Although twelve slots have been shown in FIG. 3 around the outer perimeter 74 of the disk 68, it should be understood that any number of slots and corresponding fasteners 84 may be provided.

The first ring 76 has a recess 90 and a flange 92. Similarly, the second ring 78 has a recess 94 and a flange 96. The recesses 90 and 94 and the flanges 92 and 96 of the first and second rings 76 and 78 are arranged to form a chamber 98 within which a T-shaped flange 100 of the blade 72 is confined so that the blade 72 is retained by the retainer ring 70.

The first ring 76 may be provided with a plurality of recesses, such as the recess 90, and a plurality of flanges, such as the flange 92. Similarly, the second ring 78 may be provided with a plurality recesses, such as the recess 94, and a plurality of flanges, such as the flange 96. These recesses and flanges of the first ring 76 cooperate with corresponding recesses and flanges of the second ring 78 to form a plurality of chambers, such as the chamber 98. Each such chamber receives a T-shaped flange 100 of a corresponding blade 72 so that the retainer ring 70 mounts a plurality of blades 72 around the outer perimeter 74 of the disk 68. The number of blades 72 distributed around the outer perimeter 74 of the disk 68 by the retainer ring 70 may be more or fewer than the number of fasteners 84 and/or the number of slots 88 receiving the fasteners 84 of the retainer ring 70.

With the arrangement shown in FIGS. 1–4, aerodynamic forces exerted on the blades 72 by the combustor section 20 of the gas turbine engine 10 are transferred to the disk 68 by way of the retainer ring 70 and the fasteners 84. Accordingly, the disk 68 and the blades 72 rotate in response to these aerodynamic forces. The fasteners 84 also function to prevent the retainer ring 70 from sliding around the disk 68. As the disk 68 and the blades 72 rotate in response to the aerodynamic forces acting on the blades 72, the cumulative centrifugal forces of the blades 72 are not transferred to the disk 68. That is, the retainer ring 70 isolates the disk 68 from the centrifugal forces of the blades 72. Therefore, as to these centrifugal forces, the blades 72 and the retainer ring 70 float on the outer perimeter 74 of the disk 68.

Figure 5:
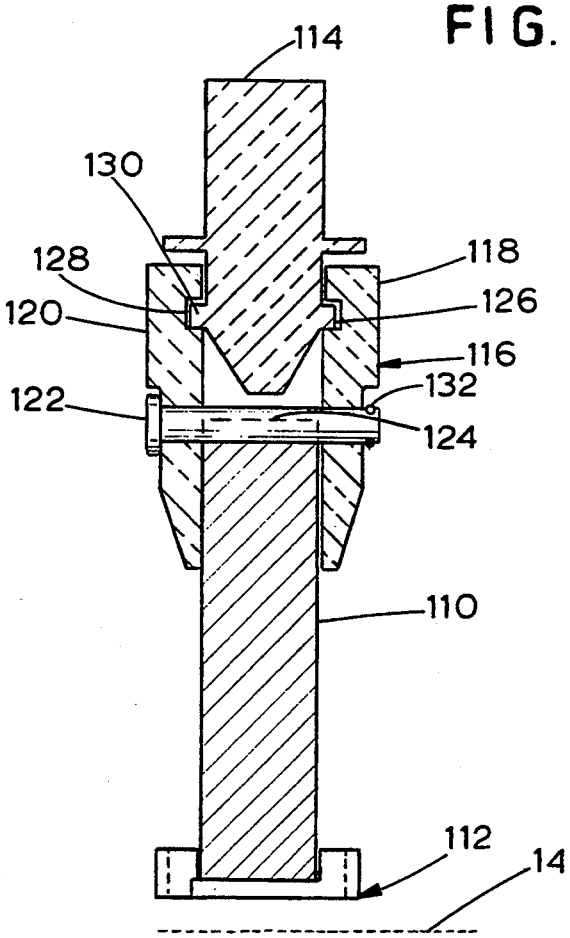
FIG. 5 is an enlarged sectional view of an alternative blade retaining arrangement according to the present invention; and, FIG. 6 is an enlarged sectional view of another alternative blade retaining arrangement according to the present invention.

A second embodiment of the present invention is shown in FIG. 5. As shown in FIG. 5, a disk 110 is suitably attached to a hub 112. A plurality of blades, such as the blade 114, receive aerodynamic forces from the combustion gases produced by the combustion section 20, and a retainer ring 116 transfers those aerodynamic forces from the blades 114 to the disk 110.

The retainer ring 116 has a first ring 118 and a second ring 120. Corresponding holes through the first and second rings 118 and 120 are arranged to receive a member in the form of a fastener 122. The fastener 122 fastens the first and second rings 118 and 120 together.

The fastener 122 fits partially within a corresponding slot around an outer perimeter 124 of the disk 110 in a manner similar to the manner in which the fastener 84 fits within the slot 88 of the disk 68.

The first ring 118 has a recess 126, and the second ring 120 has a recess 128. A flange 130 of the blade 114 protrudes into the recesses 126 and 128 so that the blade 114 is retained to the disk 110 by the retainer ring 116. As shown in FIG. 5, the fastener 122 may be in the form of a pin having a groove at an end thereof to receive a retaining clip 132. Alternatively, the fastener 122 may be a bolt and nut arrangement. The retainer ring 116 and the blade 114, for example, may be ceramic, and the disk 110, for example, may be ceramic, high temperature metal, or a high temperature composite.

The first ring 118 may be provided with a plurality of recesses, such as the recess 126, and the second ring 120 may be provided with a plurality of recesses, such as the recess 128. Each recess 126 in the first ring 118, and its corresponding recess 128 in the second ring 120, receive a flange 130 of a corresponding blade 114 so that the retainer ring 116 mounts a plurality of blades 114 around the outer perimeter 124 of the disk 110.

With the arrangement shown in FIGS. 5, aerodynamic forces exerted on the blades 114 by the combustor section 20 of the gas turbine engine 10 are transferred to the disk 110 by way of the retainer ring 116 and the fasteners 122. Accordingly, the disk 110 and the blades 114 rotate in response to these aerodynamic forces. The fasteners 122 also function to prevent the retainer ring 116 from sliding around the disk 110. As the disk 110 and the blades 114 rotate in response to the aerodynamic forces acting on the blades 114, the cumulative centrifugal forces of the blades 114 are not transferred to the disk 110. That is, the retainer ring 116 isolates the disks 110 from the centrifugal forces of the blades 114. Therefore, as to these centrifugal forces, the blades 114 and the retainer ring 116 float on the outer perimeter 124 of the disk 110.

Figure 6:
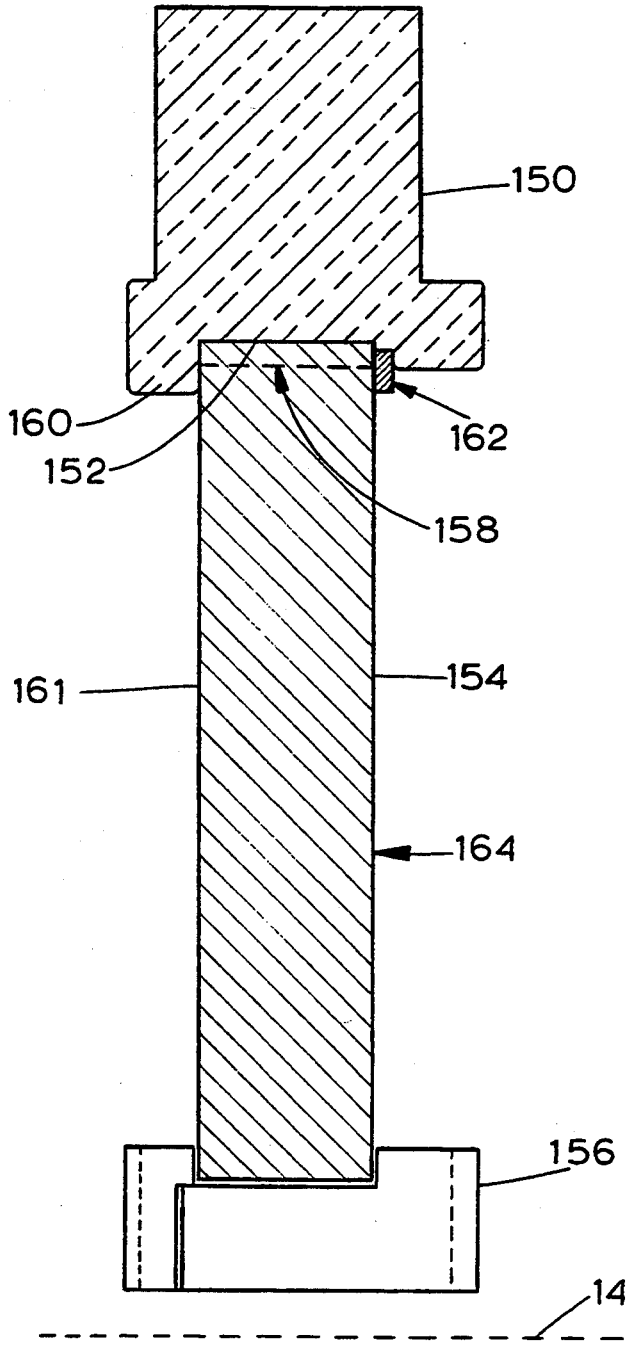

A further embodiment of the present invention is shown in FIG. 6. As shown in FIG. 6, an integral blade/ring 150 is positioned around an outer perimeter 152 of a disk 154 which is suitably attached to a hub 156. The blade/ring 150 has a plurality of members, each of which may in the form of a rib 158, and each of which fits into a corresponding one of a plurality of slots formed in the outer perimeter 152 of the disk 154. These slots may be similar to the slots 88 of the disk 68 shown in FIG. 3. To assemble the blade/ring 150 to the disk 154, the ribs 158 of the blade/ring 150 are inserted through the slots around the outer perimeter 152 of the disk 154 until an annular flange 160 of the blade/ring 150 abuts a first side 161 of the disk 154. A ring retainer 162 may be inserted between a second side 164 of the disk 154 and the blade/ring 150. The ring retainer 162 may have a one piece construction, or instead may be a plurality of individual retainers. The blade/ring 150, for example, may be ceramic, and the disk 154, for example, may be ceramic, high temperature metal, or a high temperature composite.

With the arrangement shown in FIGS. 6, aerodynamic forces exerted on the blade/ring 150 by the combustor section 20 of the gas turbine engine 10 are transferred to the disk 154 by way of the blade/ring 150 and the ribs 158. Accordingly, the blade/ring 150 and the disk 154 rotate in response to these aerodynamic forces. The ribs 158 also function to prevent the blade/ring 150 from sliding around the disk 154. As the disk 154 and blade/ring 150 rotate in response to the aerodynamic forces acting on the blade/ring 150, the cumulative centrifugal forces of the blade/ring 150 are not transferred to the disk 154. That is, the blade/ring 150 isolates the disk 154 from the centrifugal forces of the blade/ring 150. Therefore, as to these centrifugal forces, the blade/ring 150 floats on the outer perimeter 152 of the disk 154.

INDUSTRIAL APPLICABILITY

In use, the gas turbine engine 10 is started and allowed to warm up, and is used in any suitable power application. As the demand for load or power is increased, the output of the gas turbine engine 10 is increased by increasing the supply of fuel and subsequent air to the combustor section 20. As a result, the temperature within the gas turbine engine 10 increases. The aerodynamic forces produced by the combustion gases of the combustor section 20 are transferred to the disk 68, 110, or 154 by the corresponding blades 72, 114, or 150. The aerodynamic forces on the blades 72, 114, or 150 cause rotation of the corresponding disk 68, 110, or 154 in order to provide power to auxiliary equipment such as the compressor section 16 of the gas turbine engine 10. The resulting centrifugal forces on the blades 72 are isolated from the corresponding disk 68 by the retainer ring 70, the resulting centrifugal forces on the blades 114 are isolated from the corresponding disk 110 by the retainer ring 116, or the resulting centrifugal forces on the blade/ring 150 are isolated from the corresponding disk 154 by the blade/ring 150.

Since the present invention isolates the disk of the turbine wheel from the centrifugal forces of the blades mounted to the disk, the disk functions primarily (i) to spatially locate the blades so that the disk receives the aerodynamic forces from the hot gases produced by the combustor section 20 of the gas turbine engine 10, and (ii) to transmit these aerodynamic forces to the hub of the turbine wheel. The disk is not required to react to the centrifugal forces of the blades. Accordingly, the disk need not have the higher mass of disks typically used in gas turbine engines. Thus, the mass of the gas turbine engine can be reduced.

Furthermore, the present invention permits the use of lower weight, lower strength, and lower cost materials for the disk. Thus, low strength continuous fiber reenforced ceramic composite materials may be used for the disk in place of more commonly used metallic materials. Additionally, the use of continuous fiber reinforced ceramic composite materials, or their equivalent, for the disk increases the temperature capability of the rim or outer perimeter of the disk which is needed for turbine inlet temperatures greater than 2200° F.

Numerous modifications and alternative embodiments of the present invention will be apparent to those skilled in the art in view of the foregoing description. Accordingly, this description is to be construed as illustrative only and is for the purpose of teaching those skilled in the art the best mode of carrying out the present invention. The details of the structure may be varied substantially without departing from the spirit of the present invention, and the exclusive use of all modifications which come within the scope of the dependent claims is reserved.

It is claimed:

1. A turbine wheel assembly comprising:

a disk;

a blade; and, mounting means for mounting the blade to the disk so that, as the disk rotates, centrifugal forces of the blade are substantially isolated from the disk.

2. The turbine wheel assembly of claim 1 wherein the disk has an outer perimeter, wherein the disk has a slot in the outer perimeter of the disk, and wherein the mounting means comprises a member through the slot of the disk.

3. The turbine wheel assembly of claim 1 wherein the disk has an outer perimeter, wherein the disk has a slot in the outer perimeter of the disk, wherein the mounting means comprises a retainer ring, and wherein the retainer ring has a member in the slot of the disk.

4. The turbine wheel assembly of claim 1, wherein the disk has an outer perimeter, wherein the disk has a slot in the outer perimeter of the disk, wherein the mounting means comprises a retainer ring substantially commensurate with the outer perimeter of the disk, and wherein the retainer ring has a member in the slot of the disk.

5. The turbine wheel assembly of claim 1 wherein the disk has an outer perimeter, wherein the mounting means comprises first and second rings, wherein each of the first and second rings is substantially commensurate with the outer perimeter of the disk, wherein the first and second rings form a chamber having a blade retaining flange, and wherein the blade has a blade flange retained in the chamber by the blade retaining flange.

6. The turbine wheel assembly of claim 5 wherein the disk has a slot, and wherein the mounting means comprises a member inserted through the first and second rings and in the slot of the disk.

7. The turbine wheel assembly of claim 6 wherein the slot of the disk is in the outer perimeter of the disk, wherein the member is arranged to fasten the first and second rings together, and wherein the member is arranged to prevent the first and second rings from sliding around the disk.

8. The turbine wheel assembly of claim 1 wherein the disk has an outer perimeter, wherein the mounting means comprises first and second rings, wherein each of the first and second rings is substantially commensurate with the outer perimeter of the disk, wherein each of the first and second rings has a facing surface, wherein each of the facing surfaces of the first and second rings has a recess therein, and wherein the blade has a blade flange within the recesses of the facing surfaces of the first and second rings so that the blade is retained by the first and second rings.

9. The turbine wheel assembly of claim 8 wherein the disk has a slot, and wherein the mounting means comprises a member inserted through the first and second rings and in the slot of the disk.

10. The turbine wheel assembly of claim 9 wherein the slot of the disk is in the outer perimeter of the disk, wherein the member is arranged to fasten the first and second rings together, and wherein the member is arranged to prevent the first and second rings from sliding around the disk.

11. The turbine wheel assembly of claim 1 wherein the mounting means comprises a retainer ring, wherein the retainer ring and the blade are integral with one another.

12. The turbine wheel assembly of claim 11 wherein the disk has an outer perimeter, wherein the disk has a slot in the outer perimeter of the disk, and wherein the integral retainer ring and blade has a member in the slot of the disk.

13. The turbine wheel assembly of claim 1 wherein the disk has an outer perimeter, wherein the disk has a slot in the outer perimeter of the disk, wherein the mounting means comprises first and second retainer rings substantially commensurate with the outer perimeter of the disk, and wherein the mounting means comprises a fastener, wherein the fastener is in the slot and is arranged to fasten the first and second retainer rings together.

14. A turbine wheel assembly comprising:

a blade;

locating means for spatially locating the blade; and, mounting means for mounting the blade to the locating means so that, as the locating means and the blade rotate, centrifugal forces of the blade are substantially isolated from the locating means.

15. The turbine wheel assembly of claim 14 wherein the mounting means comprises a member arranged to interconnect the locating means and the mounting means.

16. The turbine wheel assembly of claim 14 wherein the mounting means comprises a retainer ring, and wherein the mounting means comprises a member arranged to interconnect the locating means and the retainer ring.

17. The turbine wheel assembly of claim 14 wherein the mounting means comprises a retainer ring substantially commensurate with an outer perimeter of the locating means, and wherein the mounting means comprises a member arranged to interconnect the locating means and the retainer ring.

18. The turbine wheel assembly of claim 14 wherein the mounting means comprises first and second rings, wherein each of the first and second rings is substantially commensurate with an outer perimeter of the locating means, wherein the first and second rings form a chamber having a blade retaining flange, and wherein the blade has a blade flange retained in the chamber by the blade retaining flange.

19. The turbine wheel assembly of claim 18 wherein the locating means has an opening in the outer perimeter, and wherein the mounting means comprises a member inserted through the first and second rings and in the opening of the locating means.

20. The turbine wheel assembly of claim 14 wherein the mounting means comprises first and second rings, wherein each of the first and second rings is substantially commensurate with an outer perimeter of the locating means, wherein each of the first and second rings has a facing surface, wherein each of the facing surfaces of the first and second rings has a recess therein, and wherein the blade has a blade flange within the recesses of the facing surfaces of the first and second rings so that the blade is retained by the first and second rings.

21. The turbine wheel assembly of claim 20 wherein the locating means has an opening at the outer perimeter, and wherein the mounting means comprises a member inserted through the first and second rings and in the opening of the locating means.

22. The turbine wheel assembly of claim 14 wherein the mounting means comprises a retainer ring, wherein the retainer ring and the blade are integral with one another.

23. The turbine wheel assembly of claim 22 wherein the locating means has an opening, and wherein the integral retainer ring and blade has a member in the opening of the locating means.

24. The turbine wheel assembly of claim 14 wherein the locating means has an outer perimeter, wherein the locating means has an opening, wherein the mounting means comprises first and second retainer rings substantially commensurate with the outer perimeter of the locating means, and wherein the mounting means comprises a fastener, wherein the fastener is in the opening and is arranged to fasten the first and second retainer rings together.

25. A turbine assembly comprising:

a hub;

a disk mounted to the hub and having an outer perimeter;

a plurality of blades arranged to receive rotation inducing forces; and, a retainer ring arranged to mount the plurality of blades to the disk at the outer perimeter of the disk so that the rotation inducing forces applied to the plurality of blades cause the plurality of blades, the disk, and the hub to rotate and so that, as the plurality of blades, the disk, and the hub rotate, centrifugal forces of the plurality of blades are substantially isolated from the disk.

26. The turbine assembly of claim 25 wherein the disk has a slot in the outer perimeter of the disk, and wherein the retainer ring includes a member in the slot of the disk.

27. The turbine assembly of claim 25 wherein the disk has a plurality of slots in and around the outer perimeter of the disk, wherein the retainer ring is substantially commensurate with the outer perimeter of the disk, and wherein the retainer ring includes a plurality of members each of which is inserted in a corresponding slot of the disk.

28. The turbine assembly of claim 25 wherein the retainer ring has first and second rings, wherein each of the first and second rings is substantially commensurate with the outer perimeter of the disk, wherein the first and second rings form a plurality of chambers having blade retaining flanges, wherein each of the blades has a blade flange, and wherein each blade flange is retained in a corresponding chamber so that the blades are retained to the disk by the first and second rings.

29. The turbine assembly of claim 28 wherein the disk has a plurality of slots, and wherein the retainer ring includes a plurality of members in corresponding slots of the disk.

30. The turbine assembly of claim 29 wherein the slots of the disk are arranged in and around the outer perimeter of the disk, and wherein at least two members of the plurality of members are arranged to fasten the first and second rings together.

31. The turbine assembly of claim 25 wherein the retainer ring has first and second rings, wherein each of the first and second rings is substantially commensurate with the outer perimeter of the disk, wherein each of the first and second rings has a facing surface, wherein each of the facing surfaces of the first and seconds rings has a plurality of recesses therein, wherein each of the blades has a blade flange, and wherein each blade flange projects into corresponding recesses of the facing surfaces of the first and second rings so that the blades are retained to the disk by the first and second rings.

32. The turbine assembly of claim 31 wherein the disk has a plurality of slots, and wherein the retainer ring includes a plurality of members in corresponding slots of the disk.

33. The turbine assembly of claim 32 wherein the slots of the disk are arranged in and around the outer perimeter of the disk, and wherein at least two members of the plurality of members are arranged to fasten the first and second rings together.

34. The turbine assembly of claim 25 wherein the retainer ring and the blade are integral with one another, wherein the disk has a plurality of slots, and wherein the integral retainer ring and blade has a plurality of ribs in the slots of the disk.

35. The turbine wheel assembly of claim 25 wherein the disk has a slot in the outer perimeter of the disk, wherein the retainer ring comprises first and second rings substantially commensurate with the outer perimeter of the disk, and wherein the retainer ring comprises a fastener, wherein the fastener is in the slot and is arranged to fasten the first and second rings together.

* * * * *